United States Patent [19]

Rushforth

[11] 4,090,298

[45] May 23, 1978

[54] GOLF TEE AWL

[76] Inventor: Harold E. Rushforth, 1918 Monument Rd., NW., Canton, Ohio 44709

[21] Appl. No.: 744,245

[22] Filed: Nov. 23, 1976

[51] Int. Cl.[2] ..... B26F 1/00

[52] U.S. Cl. ..... 30/368; 30/151; 145/46; 145/61 C; 172/370; 172/371; 273/32 B

[58] Field of Search ..... 273/32 B; 172/370, 378, 172/371, 21; 145/61 C, 46; 30/151, 368, 367, 366, 361, 358

[56] References Cited

U.S. PATENT DOCUMENTS

| | | | |
|---|---|---|---|
| 257,301 | 5/1882 | Dubreuil | 30/358 |
| 1,181,519 | 5/1916 | Gilbert | 30/366 |
| 2,741,025 | 4/1956 | Stewart | 30/368 X |
| 2,746,147 | 5/1956 | Booth | 30/151 X |
| 2,764,239 | 9/1956 | Selby | 30/366 X |
| 2,786,528 | 3/1957 | Wick | 30/151 X |
| 3,546,777 | 12/1970 | Mori | 30/151 |
| 3,759,180 | 9/1973 | Gibbons et al. | 145/61 C |
| 3,870,300 | 3/1975 | Amendola | 273/32 B |
| 4,008,741 | 2/1977 | Holstein | 145/46 |

*Primary Examiner*—Gary L. Smith
*Assistant Examiner*—J. T. Zatarga
*Attorney, Agent, or Firm*—Paul E. Milliken

[57] ABSTRACT

A golf tee awl for making holes in the ground to make it easier to insert golf tees. The awl has a circular knob-shaped handle with a sharpened shank or spike protruding therefrom and a protective sheath which covers the sharpened shank when the awl is not in use. The sheath can be fastened to the belt of the user or to a golf cart or golf accessory holder. The sheath and handle are preferably made of plastic and the shank is preferably metal.

4 Claims, 5 Drawing Figures

GOLF TEE AWL

This invention relates to a golf teel awl for making holes in the ground prior to inserting golf tees.

PRIOR ART

The closest prior art known to applicant are U.S. Pat. Nos. 1,412,745 and 2,783,536.

OBJECTS OF THE INVENTION

It is a primary object of this invention to provide a device which will penetrate hard ground to make a hole for inserting golf tees.

Another object of this invention is to provide a device which permits one to exert considerable force with the palm of the hand to drive a spike member into to the ground without hurting the hand.

Another object of the invention is to provide a golf tee hole making device which can safely be carried on the user's belt or on a golf cart accessory holder without danger of injury from the spike member used to make the holes.

These and other objects of the invention will become more fully apparent as the description proceeds in the following specification and the attached drawings.

STATEMENT OF THE INVENTION

This invention is a golf tee awl for making holes in the ground for inserting golf tees comprising: a handle portion to be held in the hand of the user; the handle portion having a palm contacting surface on one end thereof against which pressure may be exerted by the palm of the hand of the user; and a shank portion having one end thereof attached to the handle portion at the end opposite the palm contacting surface; the opposite end of the shank portion having a sharpened point to provide ease of penetration into the ground when pressure is exerted against the palm contacting surface of the handle portion.

DESCRIPTION OF THE PREFERRED EMBODIMENTS

Figure 1:
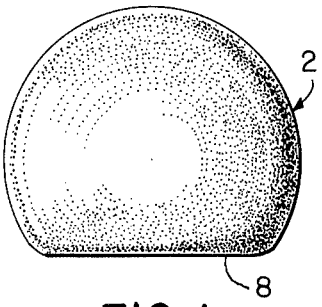
FIG. 1 is a top plan view of the device of the invention.
Figure 2:
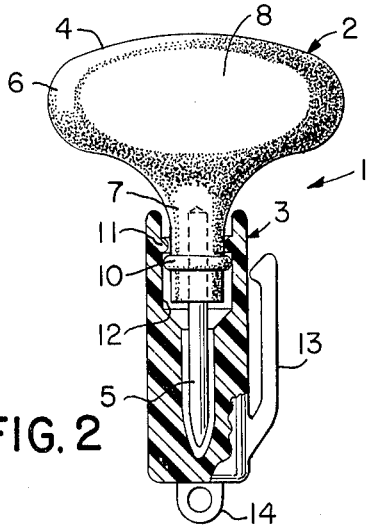
FIG. 2 is a side elevational view of the device of the invention with portions of the sheath broken away to show how the awl fits into the sheath.
Figure 3:
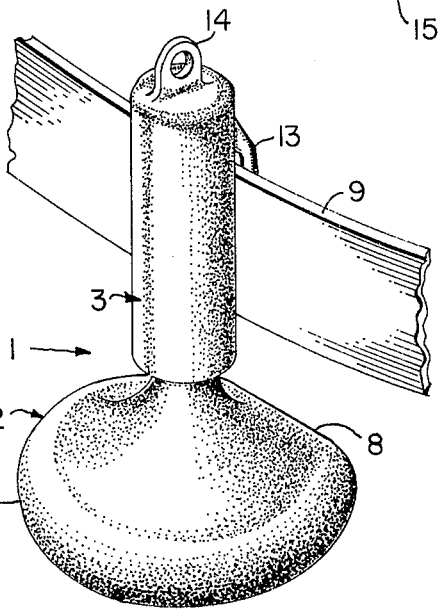
FIG. 3 is a perspective view of the invention showing the awl suspended from the sheath with the sheath connected to a belt worn by the user of the device.

Referring now to FIGS. 1 and 2 of the drawings, the entire awl and sheath assembly is indicated by the numeral 1. An awl 2 is removeably mounted in a sheath 3. The awl 2 has a handle 4 made preferably of plastic to which is attached an elongated shank or spike 5 having its free end sharpened to provide easier penetration into the ground. The handle 4 is shaped generally like one type of door knob and has a hand grippable portion 6 of substantially elliptical cross-section which merges with a shank receiving portion 7 which is frustoconical in cross-section. The grippable portion 6 has a truncated portion at one location on the circumference which forms a flat surface 8. The flat surface 8 enables the awl 2 when placed in the sheath 3 to be worn on a belt 9 of a person using the device without discomfort, since the flat surface 8 is aligned with the belt-engaging clip 13 and turned facing the wearer's hip as shown in FIG. 3. The flat surface 8 is also useful in preventing the awl 2 from rolling when placed on a surface such as a table top. A radially outwardly facing sheath retaining rib 10 extends around the circumference of the frustoconical portion 7 and cooperatively engages a radially inwardly facing rib 11 located in the axial bore 12 of the sheath 3. As illustrated in FIG. 2 the shank 5 is inserted into the bore 12 a sufficient distance that the rib 10 snaps past the rib 11 on the sheath thereby holding the awl 2 in the sheath when it is suspended upside-down as shown in FIG. 3. A chain loop 14 is located on the closed end of the sheath 3 if it is desired to fasten the sheath to a chain or line to prevent it from becoming lost when removed from the awl 2.

While the dimensions of the invention may vary somewhat, the shank 5 should be long enough to provide a hole which is deep enough to accommodate any standard size golf tee and smaller in diameter than the diameter of the golf tee at the portion that is below ground when the tee is in operative position. Golf tees may vary in diameter from 0.150 inch (3.81 mm.) to 0.200 inch (5.08 mm.), depending upon whether they are wood or plastic. A good working diameter for the shank is 0.100 inch (2.54 mm.). This produces a hole which is smaller than the diameter of the golf tees and thereby provides a force fit which should hold the tee firmly in the hole. The length of the shank may vary from 1 inch (25.4 mm.) to 1.75 inches (44.45 mm.). This range should provide a hole of sufficient depth for any standard size tee.

While for the sake of simplicity it has not been shown in the drawings, some type of fins or other protrusions may be used on the end of the shank 5 which protrudes into the shank receiving portion 7 of the handle 4, to aid in securly fastening it in the handle. If the handle 4 is plastic molded or cast around the shank it can be attached in a manner similar to that used on plastic screw driver handles. Another alternative would be for the shank to be threaded and screwed into the handle. The method of fastening these two parts together will of course depend upon the materials used.

Figure 4:
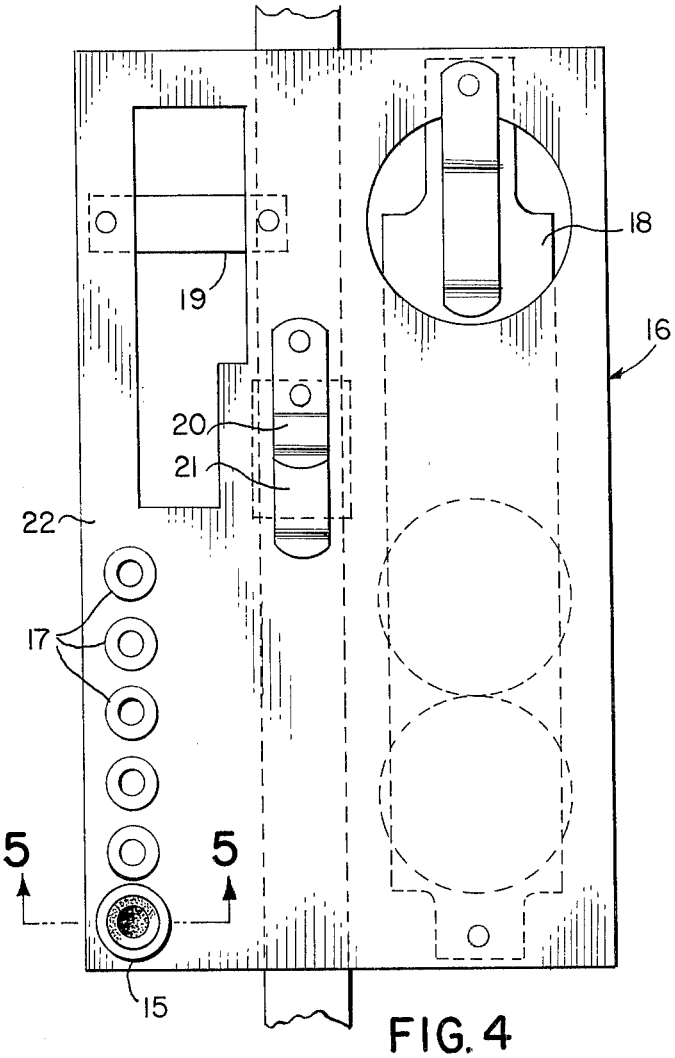
FIG. 4 is a top plan view of a golf cart "valet" or accessory holder which is attached to a golf cart handle.
Figure 5:
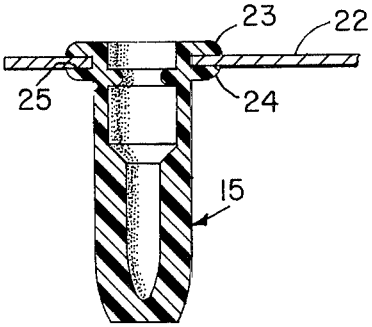
FIG. 5 is cross-sectional view taken on line 5—5 of FIG. 4 showing a modification of the invention.

In FIGS. 4 and 5 another modification of the invention is shown in which a modified sheath 15 is mounted on a golf cart "Valet" or acessory holder 16 which has a row of rubber grommets 17 for holding tees, a golf ball rack 18, a cigarette pack holder 19, a pencil clip 20 and a score card clip 21. Gold cart accessory holders of this type are manufactured by Chesal Industries of Milwaukee, Wisconsin. One of the grommets 17 may be removed from the plate 22 of the accessory holder 16 and it may be replaced by the modified sheath 15 shown in FIG. 5. The sheath has a pair of circumferential lips 23 and 24 defining therebetween an annular slot 25 which receives the plate 22 at one of the holes in the plate. The lips 23 and 24 retain the sheath 15 in the plate 22 just as the grommets 17 are retained in their respective holes in the plate. The remainder of the sheath is similar to the sheath 3 except that it does not have the belt clip 13 or the chain loop 14. A sheath could be produced, however, which would be usable on either the accessory holder or on a belt simply by combining the features of the sheath 3 in FIG. 2 with the configuration of lips 23 and 24 as used on the modified sheath 15. The sheath could then be used on a belt or on an accessory holder.

While for the purpose of illustrating the invention the handle was described as made preferably of plastic, it is obvious that it could be made of metal, rubber or any other suitable material which has the needed physical properties. The same statement can also be made with respect to the sheath and the shank of the device. The shank must of course, be made from a material which is sufficiently hard that it will not bend or break when being used to penetrate hard ground. These and various modifications can be made herein with departing from the scope of the invention.

I claim:

1. The combination of a golf tee awl for making holes in the ground for inserting golf tees, and a sheath, comprising:

a handle portion to be held in the hand of the user;

the handle portion having a palm contacting surface on one end thereof against which pressure may be exerted by the palm of the hand of the user, the transverse shape of the handle being substantially circular with a truncated portion at one location on the circumference thereof parallel to the longitudinal axis of the handle; and an axial shank portion having one end thereof attached to the handle portion at the end opposite the palm contacting surface;

the opposite end of the shank portion having a sharpened point to provide ease of penetration into the ground when pressure is exerted against the palm contacting surface of the handle portion;

the shank portion being of a diameter slightly smaller than the average diameter of a golf tee at the portion of the tee that is inserted in the ground, so that the hole produced by insertion of the shank in the ground will provide a force fit for a golf tee subsequently inserted in the hole;

the shank being of a length which will produce a hole of sufficient depth to receive the golf tee inserted therein without the need of applying excessive pressure to the golf tee to insert it in the hole; and a sheath for attachment to the golf tee awl, comprising:

a substantially tubular member having an axial receptacle therein for receiving the shank portion; and a clip attached to the exterior of the tubular member and in parallel alignment with the axis thereof, the clip being vertically aligned with the truncated portion of the handle to permit the awl to fit comfortably snugly against the hip of a person wearing a belt with the awl carrying sheath attached thereto and the truncated portion facing toward the person's hip, the sheath and awl having frictional cooperative retaining means for holding the awl in the sheath and permitting manual removal of the awl from the sheath while clipped to the belt by a simple, linear force on the handle directed away from the sheath in a line of movement coincident with the axes of the handle, shank portion, and receptacle, and parallel to the hip of the said person, the truncated handle portion permitting smooth sliding movement along the body of the said person.

2. The combination as claimed in claim 1 wherein the retaining means comprises an outwardly extending circumferential rib on the handle portion of the golf tee awl and a cooperative inwardly extending circumferential rib on the inner surface of the sheath, at least one of said ribs being sufficiently resilient to permit it to snap past the other rib when removing or replacing the sheath on the awl.

3. The combination as claimed in claim 1 including a circumferential groove in the sheath for mounting the sheath in a hole in a golf cart accessory holder of the type which holds tees, balls, score cards, and the like.

4. The combination as claimed in claim 1 wherein the handle portion has a hand-grippable portion of substantially elliptical, longitudinal cross-section and an integral shank receiving portion of substantially frustoconical, longitudinal cross-section.

* * * * *